United States Patent [19]

Ambrosini

[11] 4,382,411

[45] May 10, 1983

[54] SELF ALIGNING EXPANSIBLE SABOT PROJECTILE FOR WORN GUN TUBES

[75] Inventor: Leonard R. Ambrosini, Bettendorf, Iowa

[73] Assignee: The United States of America as represented by the Secretary of the Army, Washington, D.C.

[21] Appl. No.: 230,185

[22] Filed: Feb. 2, 1981

[51] Int. Cl.[3] ..... F42B 13/16

[52] U.S. Cl. ..... 102/523; 102/525

[58] Field of Search ..... 102/520–528

[56] References Cited

U.S. PATENT DOCUMENTS

| | | | |
|---|---|---|---|
| 3,545,383 | 12/1970 | Lucy | 102/703 |
| 3,738,279 | 6/1973 | Eyre et al. | 102/521 |
| 4,155,308 | 5/1979 | Murawski | 102/520 |
| 4,215,632 | 8/1980 | Sie | 102/521 |
| 4,296,687 | 10/1981 | Garrett | 102/523 |

FOREIGN PATENT DOCUMENTS

| | | | |
|---|---|---|---|
| 2227655 | 1/1973 | Fed. Rep. of Germany | 102/520 |

*Primary Examiner*—Harold J. Tudor

*Attorney, Agent, or Firm*—Robert P. Gibson; Anthony T. Lane; Robert O. Richardson

[57] ABSTRACT

A self aligning expansible sabot for projection from worm gun tubes without balloting of the sabot pedals due to misalignment and vibration. The sabot consists of three segments pinned together so they move radially in an expanding manner in the worm gun tube without loss of axial alignment. The connection pins allow normal discard of the sabot segments without excessive binding and without independent rotation.

3 Claims, 3 Drawing Figures

SELF ALIGNING EXPANSIBLE SABOT PROJECTILE FOR WORN GUN TUBES

GOVERNMENT RIGHTS

The invention described herein may be manufactured and/or used by or for the Government for governmental purposes without the payment of any royalty thereon.

BACKGROUND OF PRESENT INVENTION

Sabot projectiles are used when an oversized gun tube launches an undersized warhead. These projectiles have sabot petals or segments wrapped around the warhead and contact the bore of the gun tube during ejection. The sabot seals the bore to prevent escape of the propulsion gases during firing and then drops away from the warhead when it leaves the gun tube. One such projectile is an armor piercing, fin stabilized discarding sabot which has three sections around a central core or body. These sections are held together with a front bourrelet and a band or obturator at the rear. A fin assembly stabilizes the central core in flight.

A worn gun tube has an enlarged bore that is eroded due to excessive firings. Thus, its diameter exceeds that of the sabot projectile. This causes balloting of the sabot petals due to misalignment and vibration which gives the projectile a tendancy to break up in the worn tube during launch.

SUMMARY OF THE PRESENT INVENTION

In accordance with the present invention a self aligning expansible sabot for projection from worn gun tubes is provided. This sabot consists of three segments around a central core. These segments are pinned together so that they may move radially in an expanding manner in the gun tube without loss of their axial alignment. The pins are designed to allow normal discard of the sabot without any independent rotation, and without any excessive binding of the sabots during discard.

DETAILED DESCRIPTION OF PREFERRED EMBODIMENT

Figure 1:
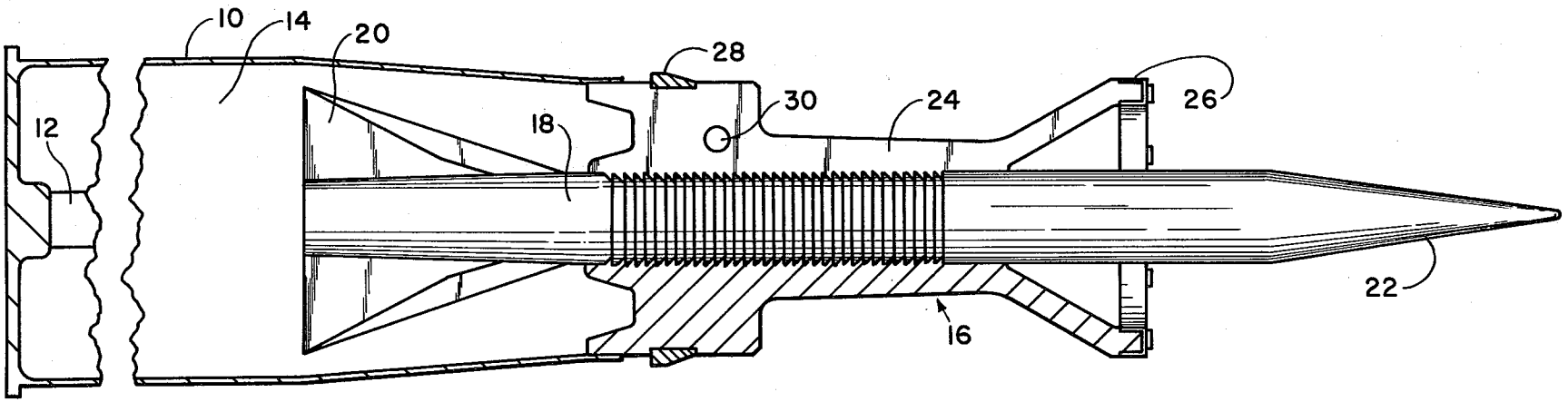
FIG. 1 is a sectional view of the sabot projectile.

Reference is now made to FIG. 1 wherein there is shown a projectile casing 10 housing a primer 12, propellant 14 and projectile 16. The projectile 16 consists of a core or body 18 having a fin assembly 20 for stabilization purposes, a windshield 22 to protect the warhead, not shown, and the sabot 24.

Figure 3:
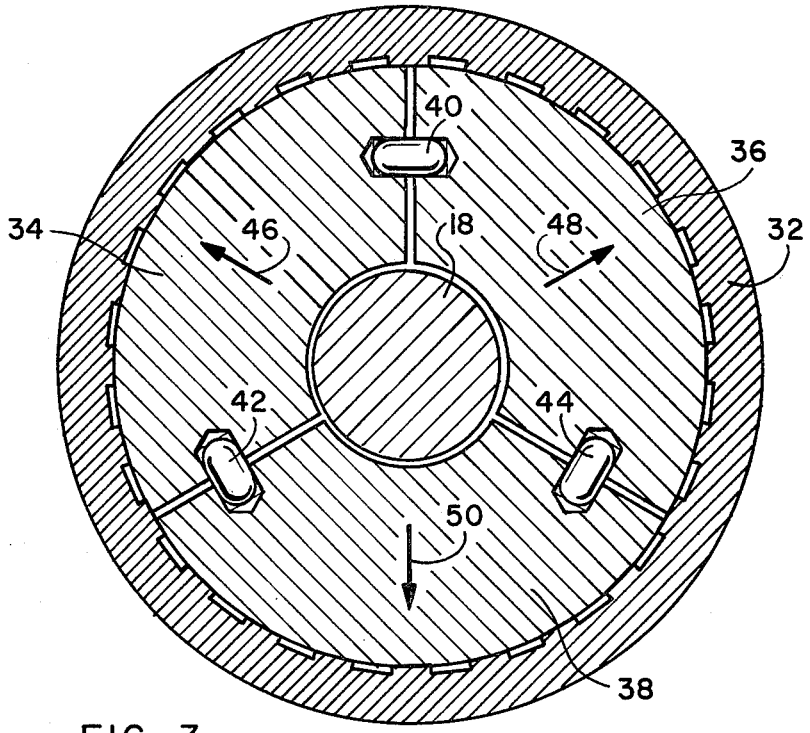
FIG. 3 is a view similar to that in FIG. 2 but with the sabot segments expanded to fit the enlarged gun tube bore.
Figure 2:
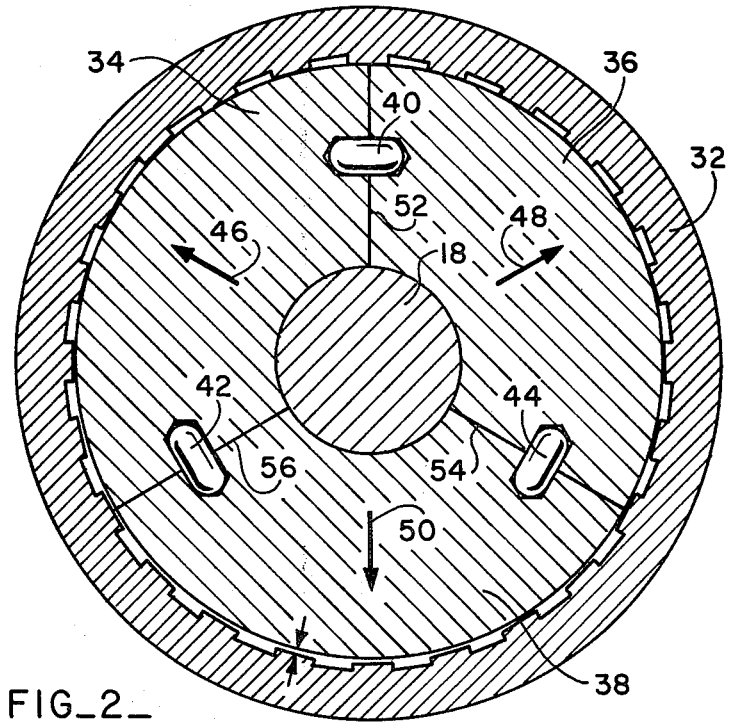
FIG. 2 is a graphic illustration of an end view of the sabot in an enlarged bore of a worn gun tube.

The sabot consists of three petals or segments which fit around the body 18 to support it as it is propelled through the gun tube, not shown. The segments are held together around the body by a bourrelet 26 at the front and a band or obturator 28 farther back. The interface between the body 18 and the sabot segments is notched in such a manner that the segments carry the body as the projectile propels through the gun tube. Air pressure between the windshield and front end of the sabot breaks the bourrelet, and depending on intentional design, and if the forces retaining the segments are higher in the front or the rear, the segment opens, consequently, first in the rear or the front, with an additional vibration forwards or backwards. The segments then fall away from the body when in flight. As can be seen in FIGS. 2 and 3, according to the present invention, the segments are pinned together. One such pin 30 is shown in FIG. 1.

Shown in FIG. 2 is the body 18 centrally supported in gun tube 32 by three sabot segments 34, 36, 38. As can be seen by the space between the gun tube bore and the circumference of the sabot, there is a loose fit due to wear on the gun tube from previous firings. It is this loose fit that effects accuracy and also causes vibration and projectile breakup during launch. A broken obturator and bourrelet in the gun tube can cause longitudinal misalignment of the sabot petals.

Pins 40, 42, 44 interconnect the sabot segments 34, 36, 38 and permit them to expand radially and contact the gun tube bore as shown in FIG. 3. As the sabot segments are projected they also spread out in the directions of arrows 46, 48, 50. In order to permit this action the axes of said pins 40, 42, 44 are normal to the line of abuttment 52, 54, 56 of the sabot segments to be joined. The pins also have a longitudinal axis transverse to the axis of the projectile body 18. This makes the expansion self-correcting since all segments have to move together to avoid binding.

The pins 40, 42, 44 can have a press fit with associated cavities in the sabot segments increasing the retaining forces. They should be only long enough to permit expansion of the segments within a worn gun tube since pins too long can cause binding when the front or the rear end of the sabot first opens up after launch to initiate sabot separation. Actually, the pins may even approach a ball bearing configuration and successfully prevent sabot petal misalignment in a worn gun tube.

The invention in its broader aspects is not limited to the specific combinations, improvements and instrumentalities described but departures may be made therefrom within the scope of the accompanying claims without departing from the principles of the invention and without sacrificing its chief advantages.

I claim:

1. A self-aligning expansible sabot projectile for use with a worn gun tube, said sabot projectile comprising:

An elongated body having front and rear ends, a plurality of sabot segments around said body to axially align said body within said gun tube, said segments bieng held together with a front bourrelet and an obturator circumferentailly placed therearound, said sabot segments having abutting surfaces forming planes extending radially from said body outwardly, said planes extending longitudinally the length of said segments, and pins interconnecting said segments, said pins passing through said planes in a direction normal thereto, said pins having a longitudinal axis transversse to the axis of said elongated body said pins being located in cavities formed in said sabot segments, wherein said pins axially and radially align said segments while being projected through said gun tube, said segments thereafter separating from said body in flight, without any binding of the segments.

2. A self-aligning expansible sabot as as set forth in claim 1 wherein said sabot body has a fin assembly at one end thereof and a windshield at the other.

3. A self-aligning expansible sabot as set forth in claim 1 wherein said pins while axially and radially aligning said segments are press fitted into said cavities by a known amount of force, contributing to the total amount of force retaining the segments together.

* * * * *